US008213622B2

(12) United States Patent
Sakurai et al.

(10) Patent No.: US 8,213,622 B2
(45) Date of Patent: Jul. 3, 2012

(54) BINAURAL SOUND LOCALIZATION USING A FORMANT-TYPE CASCADE OF RESONATORS AND ANTI-RESONATORS

(75) Inventors: Atsuhiro Sakurai, Ibaraki (JP); Steven Trautmann, Ibaraki (JP)

(73) Assignee: Texas Instruments Incorporated, Dallas, TX (US)

( * ) Notice: Subject to any disclaimer, the term of this patent is extended or adjusted under 35 U.S.C. 154(b) by 387 days.

(21) Appl. No.: 12/716,877

(22) Filed: Mar. 3, 2010

(65) Prior Publication Data

US 2010/0158258 A1 Jun. 24, 2010

Related U.S. Application Data

(62) Division of application No. 10/983,251, filed on Nov. 4, 2004, now Pat. No. 7,680,289.

(51) Int. Cl.
*H04R 5/00* (2006.01)
*H04R 1/10* (2006.01)

(52) U.S. Cl. ..... 381/17; 381/18; 381/307; 381/27; 381/63

(58) Field of Classification Search ..... 381/1, 17–20, 381/307, 309, 310, 27, 63
See application file for complete search history.

(56) References Cited

U.S. PATENT DOCUMENTS

| | | | | |
|---|---|---|---|---|
| 5,333,200 | A * | 7/1994 | Cooper et al. | 381/1 |
| 5,657,391 | A * | 8/1997 | Jyosako | 381/1 |
| 6,421,446 | B1 * | 7/2002 | Cashion et al. | 381/17 |
| 6,956,954 | B1 * | 10/2005 | Takemura et al. | 381/307 |
| 7,095,865 | B2 * | 8/2006 | Katayama et al. | 381/309 |
| 7,536,017 | B2 * | 5/2009 | Sakurai et al. | 381/17 |
| 7,680,289 | B2 * | 3/2010 | Sakurai et al. | 381/309 |
| 7,801,312 | B2 * | 9/2010 | Kasai et al. | 381/17 |
| 7,835,535 | B1 * | 11/2010 | Trautmann et al. | 381/310 |
| 8,116,469 | B2 * | 2/2012 | Smirnov et al. | 381/63 |

* cited by examiner

*Primary Examiner* — Xu Mei
(74) *Attorney, Agent, or Firm* — Robert D. Marshall, Jr.; Wade James Brady, III; Frederick J. Telecky, Jr.

(57) ABSTRACT

This invention is a method for binaural localization using a cascade of resonators and anti-resonators to implement an HRTF (head-related transfer function). The spectrum of the cascade reproduces the magnitude spectrum of a desired HRTF. The proposed method provides a considerably more computationally efficient implementation of HRTF filters with no detectable deterioration of output quality while saving memory when storing a large quantity of HRTFs due to the parameterization of its resonators and anti-resonators. Finally, the method offers additional flexibility since the resonators and anti-resonators can be manipulated individually during the design process, making it possible to interpolate smoothly between HRTFs, reduce spectral coloring or achieve higher accuracy at perceptually relevant frequency regions. These HRTF are useful in stereo enhancement and multi-channel virtual surround simulation.

8 Claims, 4 Drawing Sheets

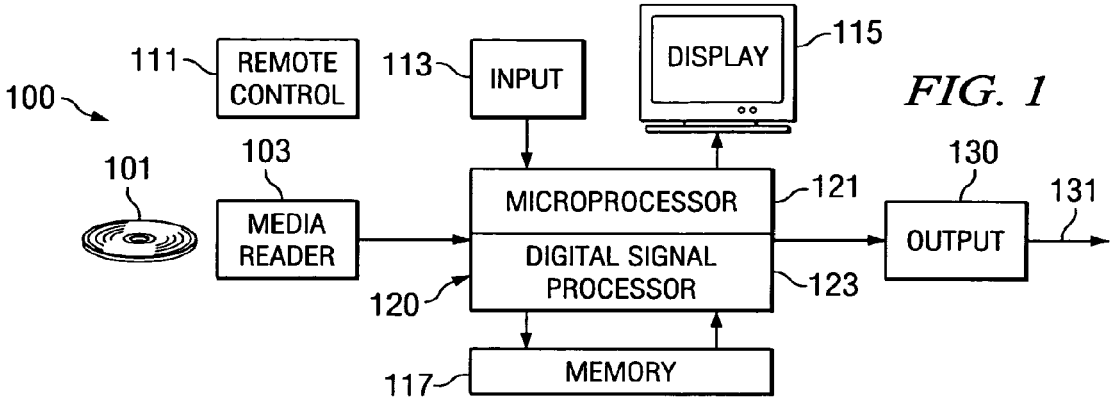
FIG. 1
FIG. 2a
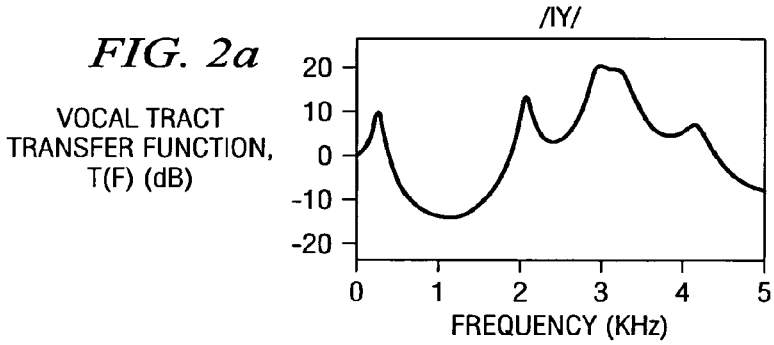
FIG. 2b
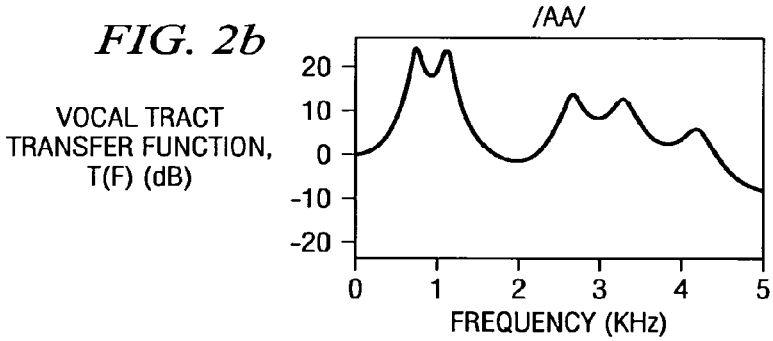
FIG. 2c
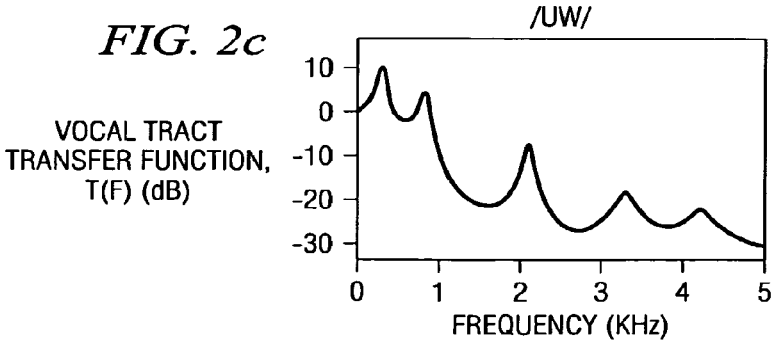

BINAURAL SOUND LOCALIZATION USING A FORMANT-TYPE CASCADE OF RESONATORS AND ANTI-RESONATORS

CLAIM OF PRIORITY

This application is a divisional of U.S. patent application Ser. No. 10/983,251 filed Nov. 4, 2004.

TECHNICAL FIELD OF THE INVENTION

The technical field of this invention is head related transfer functions in binaural sound.

BACKGROUND OF THE INVENTION

Currently available implementations of head-related transfer function (HRTF) filters are extremely computation expensive and require a large amount of memory for storing filter coefficients. This invention solves both problems and still provides additional advantages resulting from its flexibility.

An important feature of most DVD players and home theater systems is their ability to provide a more realistic sound experience than is possible with conventional stereophonic systems through the use of multi-channel audio. Some systems employ 5, 6 or more audio channels plus an additional low frequency extension (LFE). However, the cost of multi-speaker systems has created the need to simulate multi-channel audio using conventional stereophonic systems. This is done by virtual surround systems, which employ algorithms that try to localize sounds in virtual space using head-related transfer functions (HRTFs). Other situations may pose further restrictions related to computational cost and memory, making it difficult to implement virtual surround systems. In these cases, there is a need for an algorithm that creates a wider sound image by processing only two channels of audio. This is called stereo enhancement. Stereo enhancement can also improve the sound quality of conventional stereo music, particularly of early recordings with excessive inter-channel separation or extremely narrow sound image. The problem to be solved consists of processing a conventional stereo signal to create a wider sound image by using 3D audio techniques.

Current methods for stereo enhancement show undesirable artifacts such as spectral coloring and weakening of vocals. Spectral coloring usually occurs as a consequence of the use of HRTF filters for spatial localization. Weakening of vocals is a consequence of the manipulation of the amount of correlation between left and right channels. Conventional virtual surround systems use only HRTF filters to achieve virtual sound localization.

The prior art includes a number of virtual surround systems using HRTF to localize sounds in virtual space requiring either 2 loudspeakers or headphones. However, these systems encounter a number of technical limitations. For example an HRTF may vary considerably from person to person. Real listening rooms have unpredictable shapes and furniture layout causing unwanted reflections. Some prior art systems use head-mounted speakers and others try to increase robustness by modulating auditory cues.

SUMMARY OF THE INVENTION

This invention uses a cascade of resonators and anti-resonators similar to those used in speech synthesizers to model the vocal tract transfer function for implementing HRTF filters. This differs from all conventional methods to implement HRTFs using FIR filters. This also differs from any prior infinite impulse response (IIR) filter implementation because the HRTF is modeled as a cascade connection of basic resonators and anti-resonators making use of the similarity between HRTFs and the vocal tract transfer function.

The present invention provides a more computationally efficient implementation of HRTF filters with no detectable deterioration of output quality. This invention saves considerable memory when storing a large quantity of HRTFs, since each resonator can be parameterized by its bandwidth and central frequency. This invention offers additional flexibility because the individual resonators and anti-resonators can be manipulated independently during the design process. This makes it possible to interpolate smoothly between HRTFs at different angles or to achieve higher accuracy at perceptually relevant frequency regions.

This invention enables elimination of spectral coloring by manipulating the shape of the resonators and anti-resonators used as HRTF filters. This invention is not based on the manipulation of the amount of correlation between left and right channels and consequently does not weaken vocals.

This invention finds use in stereo enhancement to achieve higher quality than currently available commercial systems. This invention can provide a wider sound image without any vocal weakening artifact. Spectral coloring is also very small and can be easily controlled using a design method based on formant-type IIR filters.

This invention achieves a wider sound effect compared to conventional virtual surround systems by using reverberation. The artificial reverberation widens the virtual sound image and is less computation-expensive than the prior art. This invention can be implemented even on resource limited hardware by using efficient formant-type IIR HRTF filters. Informal listening suggests that the proposed virtual surround system outperforms other commercially available systems.

BRIEF DESCRIPTION OF THE DRAWINGS

These and other aspects of this invention are illustrated in the drawings, in which:

FIG. 1 illustrates a system to which the present invention is applicable;

FIGS. 2*a*, 2*b* and 2*c* illustrate examples of vowel spectral envelopes;

DETAILED DESCRIPTION OF PREFERRED EMBODIMENTS

Figure 3A:
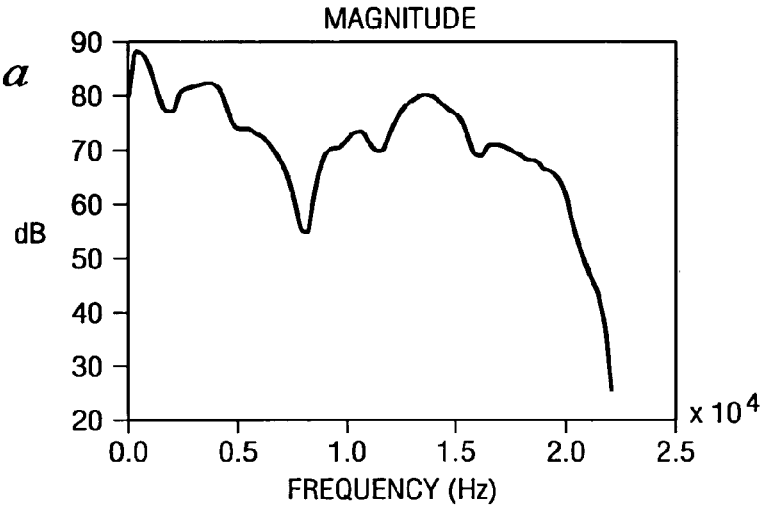
FIGS. 3*a* and 3*b* illustrate example HRTF magnitude spectra.

FIG. 1 is a block diagram illustrating a system to which this invention is applicable. The preferred embodiment is a DVD player or DVD player/recorder in which the 3D sound localization time scale modification of this invention is employed.

System 100 received digital audio data on media 101 via media reader 103. In the preferred embodiment media 101 is a DVD optical disk and media reader 103 is the corresponding disk reader. It is feasible to apply this technique to other media and corresponding reader such as audio CDs, removable magnetic disks (i.e. floppy disk), memory cards or similar devices. Media reader 103 delivers digital data corresponding to the desired audio to processor 120.

Processor 120 performs data processing operations required of system 100 including the 3D sound localization of this invention. Processor 120 may include two different processors microprocessor 121 and digital signal processor 123. Microprocessor 121 is preferably employed for control functions such as data movement, responding to user input and generating user output. Digital signal processor 123 is preferably employed in data filtering and manipulation functions such as the 3D sound localization of this invention. A Texas Instruments digital signal processor from the TMS320C5000 family is suitable for this invention.

Processor 120 is connected to several peripheral devices. Processor 120 receives user inputs via input device 113. Input device 113 can be a keypad device, a set of push buttons or a receiver for input signals from remote control 111. Input device 113 receives user inputs which control the operation of system 100. Processor 120 produces outputs via display 115. Display 115 may be a set of LCD (liquid crystal display) or LED (light emitting diode) indicators or an LCD display screen. Display 115 provides user feedback regarding the current operating condition of system 100 and may also be used to produce prompts for operator inputs. As an alternative for the case where system 100 is a DVD player or player/recorder connectable to a video display, system 100 may generate a display output using the attached video display. Memory 117 preferably stores programs for control of microprocessor 121 and digital signal processor 123, constants needed during operation and intermediate data being manipulated. Memory 117 can take many forms such as read only memory, volatile read/write memory, nonvolatile read/write memory or magnetic memory such as fixed or removable disks.

Output 130 produces an output 131 of system 100. In the case of a DVD player or player/recorder, this output would be in the form of an audio/video signal such as a composite video signal, separate audio signals and video component signals and the like.

Three-dimensional sound localization is an important element of current multimedia applications, as demonstrated by the proliferation of multi-channel home theater systems and three dimensional (3D) video games. Binaural sound localization refers to the creation of 3D localization effects using a pair of signals for the left and right ears. The HRTF is defined as the transfer function from the sound source to the inner ear. Thus a pair of HRTFs from the source to both ears can be used to accurately generate binaural signals at the eardrums.

An HRTF is typically implemented by convolving its corresponding impulse response, called head-related impulse response (HRIR), with the input signal using a finite impulse response (FIR) filter with typically more than 100 coefficients. This represents a computational bottleneck for most portable DSP applications. This invention uses a cascade of resonators and anti-resonators to implement the HRTF filter. The cascade is structurally similar to those used in speech synthesis to model the transfer function of the vocal tract. These functions are computationally efficient and flexible enough to cope with continuously changing formant frequencies during speech synthesis. For this reason, the cascade structure is also capable of modeling the magnitude spectrum of an HRTF in a very efficient and flexible manner. For example, the zero-elevation, zero-degree azimuth HRTF filter for the left ear can be realized using a cascade containing just three second-order IIR filters. This is considerably more computationally efficient than any FIR filter approach. It is also more efficient than other IIR filter approaches due to its flexibility. By individually tuning its resonators and anti-resonators, the cascade can be designed to achieve higher accuracy for perceptually significant frequency regions and provide just a rough approximation in other frequency regions. The cascade can also be easily modified to show less spectral coloring at specific frequency regions, or interpolate between HRTFs corresponding to different angles. In addition, the resonators and anti-resonators are parameterized and can be completely represented by their bandwidths and central frequencies. This saves considerable memory when storing a large number of HRTFs. Listening tests show that localization results achieved by this invention are undistinguishable from those obtained using FIR filters.

An important psychoacoustic property of binaural signals is the precedence effect. Human listeners rely on the first wave front for sound localization. This principle explains why humans are able to localize sounds in reverberant environments, where the sound coming directly from the source (direct path) is soon followed by several second, third, and higher order reflections mixed with the direct sound. A direct consequence is that the importance of the phase information contained in the HRIR is related primarily to the initial delay. A similar effect can be obtained from any impulse response with the same magnitude spectrum, provided that it contains the same initial delay. Therefore, the HRIR can be transformed into a minimum-phase impulse response with the same magnitude spectrum preceded by a delay. Likewise, it is also possible to realize the HRIR using IIR filters with the same magnitude spectrum preceded by the correct delay.

Connecting resonators and anti-resonators in cascade is a technique widely used in formant-type speech synthesizers. Speech signals are modeled as the convolution of an excitation signal with a vocal tract filter. For voiced sounds (e.g. vowels, nasals, and voiced fricatives) the excitation signal can be represented by a train of glottal pulses separated by the fundamental period (1/FO). The vocal tract filter is represented by a cascade connection of resonators and anti-resonators that models the effect of the vocal tract. The glottal source is responsible for the fine structure of a voiced speech spectrum. The vocal tract transfer function shapes the spectral envelope. This envelope is characterized by a finite number of resonant frequencies called formants, which appear in the form of peaks and contain a significant amount of phonetic information.

FIGS. 2*a*, 2*b* and 2*c* illustrate examples of vowel spectral envelopes. FIG. 2*a* illustrates the vocal spectral envelope for the vowel /IY/. FIG. 2*b* illustrates the vocal spectral envelope for the vowel /AA/. FIG. 2*c* illustrates the vocal spectral envelope for the vowel /UW/. The shape of these spectral envelopes reveals that the difference in formant structure between vowels is significant, and that the cascade connection can flexibly cope with such variations.

The cascade of resonators and anti-resonators is an extremely convenient method for spectral envelope shaping due to its simplicity and flexibility. Formant frequencies vary continuously along the utterance, and speech synthesizers manage to update their parameters accordingly.

Figure 3B:
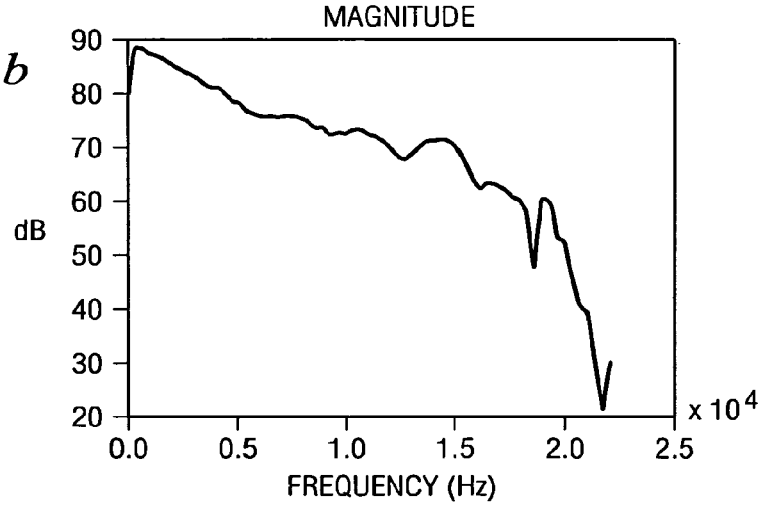

This invention takes advantage of the efficiency and flexibility of formant-type cascade structures to implement HRTF filters. FIGS. 3*a* and 3*b* illustrate example HRTF magnitude spectra. FIG. 3*a* illustrates the magnitude spectrum of a 0-elevation, 60 degree azimuth HRTF for the left ear. FIG. 3*b* illustrates the magnitude spectrum of a 0-elevation, 90 degree azimuth HRTF for the left ear. These spectra can be approximated by a finite number of peak frequencies, similar to those observed in the spectral envelope of voiced speech signals.

The method of this invention of implementing HRTF filters using a formant-type cascade of resonators and anti-resonators is detailed below. The basic resonator and anti-resonator is described by the following difference equation:

$$y(n)=Ax(n)+By(n-1)+Cy(n-2)$$

where: $C=-e^{(-2\pi\cdot BW\cdot T)}$; $B=2e^{(-\pi\cdot BW\cdot T)}\cos(2\pi\cdot F\cdot T)$; and $A=1-B-C$; BW is the bandwidth of the peak in Hertz; T is the sampling period; and F is the resonant frequency in Hertz.

The anti-resonator is implemented as a notch filter with difference equation:

$$y(n)=x(n)+Dx(n-1)+x(n-2)+Ey(n-1)+Fy(n-2)$$

where: $D=-2\cos\theta$; $E=2d\cos\theta$; $F=-d^2$; and $\theta=2\pi F\cdot T$; d is a constant in the range [0.8, 1.0] related to the bandwidth; T is the sampling period; and F is the anti-resonant frequency in Hertz.

The design process creates a cascade structure that approximates a given HRTF magnitude spectrum. The first step selects the number of resonators and anti-resonators required to approximate the desired spectrum. The number of resonators is the number of prominent peaks. The number of anti-resonators is the number of valleys that are significantly deeper than the natural valleys between the peaks. In the next step, the parameters BW and F for the individual resonators and d and F for the anti-resonators are adjusted to approximate spectra. Currently this process may be executed by hand or by an automated approach.

Figure 4:
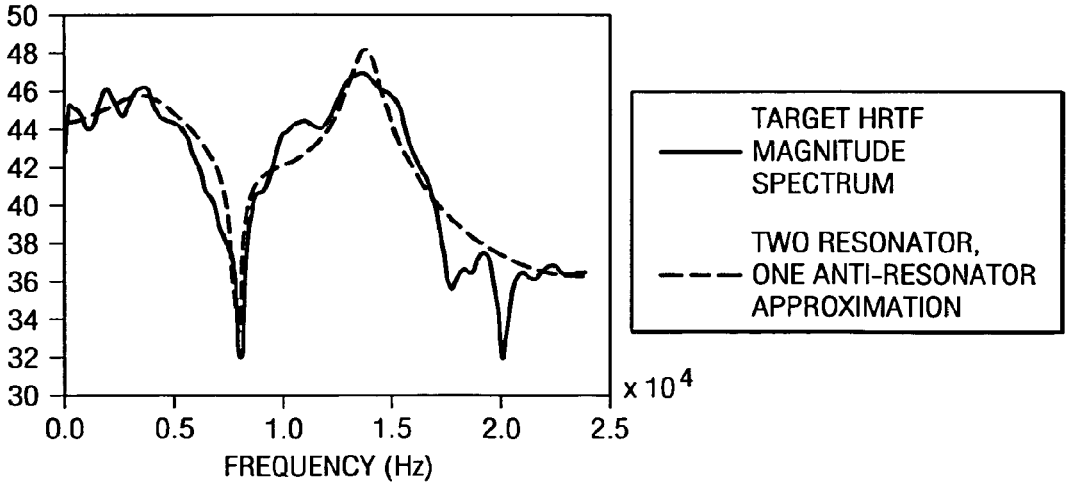
FIG. 4 illustrates an example of an HRTF magnitude spectrum designed using a cascade connection of resonators and anti-resonators.

FIG. 4 illustrates an example of an HRTF magnitude spectrum designed using a cascade connection of resonators and anti-resonators. FIG. 4 shows that a good approximation is possible using only 2 resonators and 1 anti-resonator, i.e., three 2nd-order filters.

Listening tests compared this proposed method to localize a piano note at 90-degree azimuth with a HRTF using FIR filters as in the prior art. The results showed no perceptual difference. Additional listening test comparing this method with the prior art FIR filters used to build a binaural 4-channel virtual surround system provided similar results.

Using this invention to implement HRTF filters provides enhanced flexibility of design. The HRTF filters of this invention can be adjusted independently at different frequency regions by modifying individual resonators. Such modifications may become necessary to satisfy particular requirements related to spectral coloring or as a means to interpolate between two HRTF spectra in order to change the perceived location of a sound.

This invention provides significant memory savings. This invention stores only a few parameters needed per HRTF instead of hundreds of long FIR filters of the prior art. Furthermore, the number of stored HRTFs can be minimized using interpolation of parameters whenever possible.

One application of the HRTF of this invention is stereo enhancement. A large number of stereo enhancement schemes have been proposed and many are commercially available. Most prior art stereo enhancement schemes manipulate the amount of correlation between left and right channels. The schemes typically also make direct or indirect use of HRTFs for sound localization. However, the sound field enhancement achieved by such systems often comes at the expense of undesirable artifacts such as spectral coloring and weakening of vocals. Sound coloring is a consequence of the use of HRTFs and depends upon the amount of processing performed on the signal. The weakening of vocals occurs as a consequence of reducing the correlation between left and right channels. This weakened correlation is an intrinsic part of most currently known stereo enhancement algorithms. One embodiment of this invention solves both these problems by using a special IIR filter design procedure as described above and a reverberation scheme that does not rely on the amount of correlation between left and right channels.

The stereo enhancement scheme of this invention is based on artificial reverberation and does not try to manipulate the amount of correlation between left and right channels. For this reason, the vocal weakening effect is not observed. This invention causes minimal coloring of the original signal by designing the HRTF filters interactively using the method described in above.

Figure 5:
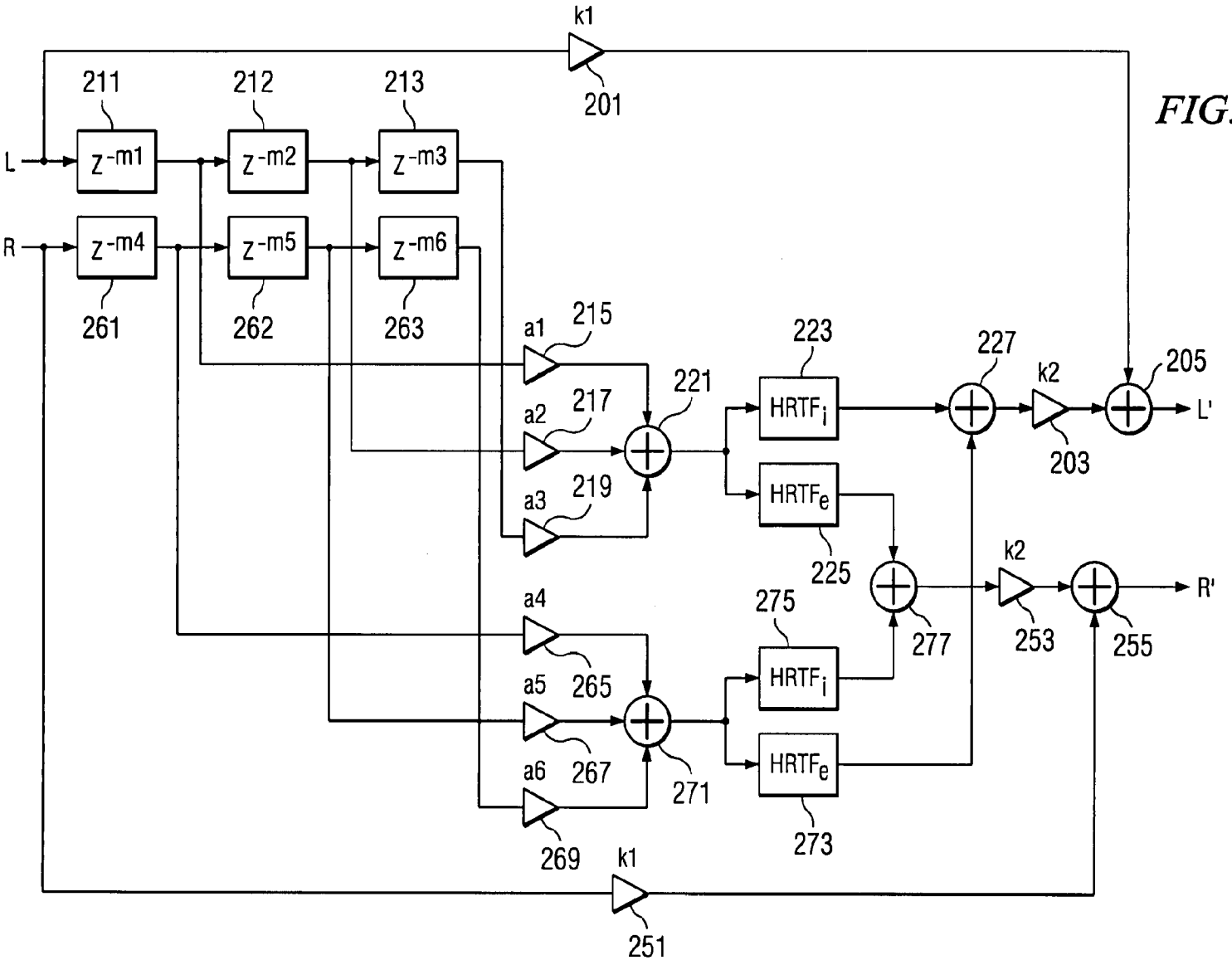
FIG. 5 illustrates a block diagram of the stereo enhancement circuit of this invention.

FIG. 5 illustrates a block diagram of the stereo enhancement circuit of this invention. This circuit receives left channel input L and right channel input R and generates stereo enhanced left channel output L' and stereo enhanced right channel output R'. Left channel input L is supplied to gain driver 201 having a gain factor of k1. The output of gain driver 201 supplies an input of summer 205. The output of summer 205 is the stereo enhanced left channel output L'. Left channel input L supplied a series of cascade delay elements 211, 212 and 213. Delay elements 211, 212 and 213 have respective delays of m1, m2 and m3. The output of delay element 211 supplies the input of delay element 212 and the input of attenuator 215. Attenuator 215 has an attenuation of a1. The output of delay element 212 supplies the input of delay element 213 and the input of attenuator 217. Attenuator 217 has an attenuation of a2. The output of delay element 213 supplies the input of attenuator 219. Attenuator 219 has an attenuation of a3. The outputs of attenuators 215, 217 and 219 are summed in summer 221.

The output of summer 221 supplies the inputs of two head related transfer functions. These are: ipsilateral HRTF 223; and contralateral HRTF 225. The output of ipsilateral HRTF 223 supplies one input of summer 227. The output of summer 227 supplies the input of gain driver 203. Gain driver 203 has a gain of k2. The output of gain driver 203 supplies the second input of summer 205. The output of contralateral HRTF 225 supplies one input of summer 277.

FIG. 5 illustrates a similar structure for the right channel input R. These include: delay elements 261, 262 and 263 with respective delays of m4, m5 and m5; attenuators 265, 267 and 269 with respective attenuations of a4, a5 and a6; summer 271; ipsilateral HRTF 273; contralateral HRTF 275; summer 277; gain driver 253 with a gain of k2; and summer 255.

This invention provides artificial reverberation through a combination of delays applied separately to each channel. The delays represent reflections off walls and can be controlled by adjusting delay parameters m1 through m6. Care should be taken to avoid echoing or distortion due to improper choice of delay values. A total delay of the order of 40 ms seems to be appropriate to obtain reverberant speech and music signals. It is also important to choose different delays for the left and right channels to cope with highly left-right correlated or even monaural signals. The delayed signals are attenuated by independent attenuation factors a1 through a6 and then mixed. The attenuation factors represent energy loss due to reflections. The mixture of delayed signals is then localized at virtual speaker positions of 90/270 degrees using a pair of ipsilateral and contralateral HRTF filters for each channel. The ipsilateral HRTF filter represents the ipsilateral path from the virtual speaker to the closer ear, and the contralateral HRTF filter represents the contralateral path from the virtual speaker to the farther ear. The HRTFs are implemented as IIR filters as described above. In a currently preferred embodiment, the cascade contains only one IIR filter to achieve low computational cost and small spectral coloring. The resulting pair of signals is finally mixed with the corresponding original signal. The mixing weights k1 and k2 are selected empirically based on the allowable amount of spectral coloring. Optionally, the resulting output signals L' and R' feed a cross-talk canceller for the case of speaker-based systems. For headphone listening, the output signals L' and R' are the final outputs.

This technique has been carefully evaluated in terms of timbre and spaciousness of the sound field using several test signals that include speech, live rock concerts, jazz, cello solo and movie soundtracks. Signals processed by this scheme and then by a cross-talk canceller produce transaural signals for a stereophonic loudspeaker system. Listening tests show that this invention outperforms other stereo enhancement schemes due to the small level of spectral coloring and the wide stereo enhancement effect.

Another application of the HRTF of this invention is virtual surround sound. Sound localization in virtual space is commonly achieved using HRTF filters that reproduce the transformations suffered by sound as they travel from the sound source to our ears. For example, a virtual sound source located at 30 degrees azimuth can be created by filtering a signal using a pair of HRTF filters corresponding to 30 and 330 degrees and presenting the binaural outputs through headphones. Current virtual surround systems are based on this principle, but differ in the way HRTF filters are implemented. A conventional virtual surround system with 4 input channels and 2 output channels would employ respective HRTF filters for the ipsilateral (short) and contralateral (long) paths. In the case of loudspeaker systems the left and right outputs undergo cross-talk cancellation to eliminate the cross-talk from the left speaker to the right ear and vice-versa.

A typical problem with the basic configuration of the prior art is low robustness against problems such as HRTF variability from person to person, unpredictable room shapes and furniture layout, etc. As a practical consequence, the resulting sound does not show the desired sensation of spaciousness, particularly for the surround channels.

Previous studies indicate that artificial reverberation can help increase the apparent size of the listening room by simulating the effect of early reflections. A known prior art technique takes a monaural input and creates a reverberant stereo output by mixing delayed copies of the input signal. Delays are adjusted by corresponding delay parameters and mixing weights are controlled by corresponding attenuation. Each of the two resulting mixtures is added to a delayed and low-passed version of the other and finally mixed with the original input weighted by respective gain parameters.

Figure 6:
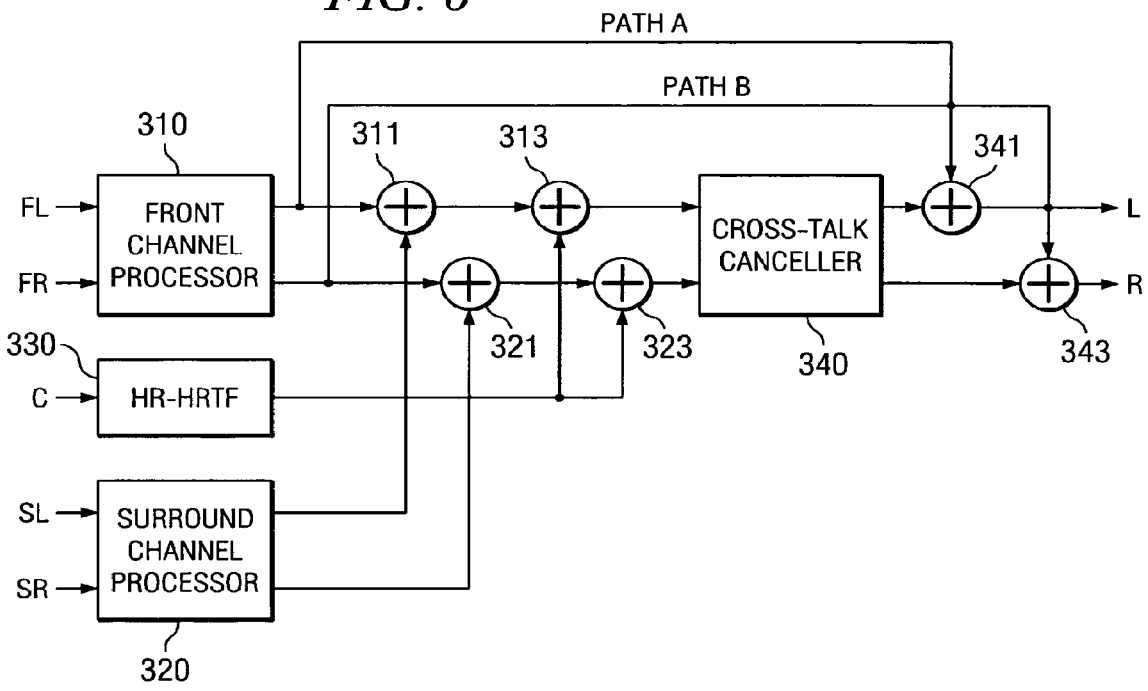
FIG. 6 illustrates a block diagram of the virtual surround simulator of this embodiment of this invention.

FIG. 6 illustrates a block diagram of the virtual surround simulator of this embodiment of this invention. Front channel processor 310 receives the two front channel signals FL and FR and produces two outputs. Front channel processor 310 has two configurations: by-pass or delay followed by attenuation; and the reverberation unit illustrated in FIG. 5. In the former case, the output of front channel processor 310 is directly mixed with the final output via PATH A in summers 341 and 343. In the latter configuration, the output is mixed with other channels before cross-talk cancellation via PATH B. Surround channel processor 320 receives the two surround channel signals SL and SR and produces two outputs. Surround channel processor 320 is always a reverberation unit as illustrated in FIG. 5. Note that both front channel processor 310 and surround channel processor 320 allow for controlling the desired amount of reverberation by changing internal parameters of the reverberator. Usually a wide surround effect can be achieved by setting the HRTF angles of front channel processor 310 at 90/270 degrees and those of surround channel processor 320 at 110/250 degrees. The center channel C is processed by the highly efficient HRTF filter 330 as described above.

This virtual surround scheme was carefully evaluated in terms of timbre and spaciousness using several test signals. These tests showed that this scheme outperforms other virtual surround schemes due to the spaciousness of the resulting sound image.

What is claimed is:

1. The method of multi-channel surround sound simulation comprising the steps of:

selectively reverberating a front left channel and a front right channel;

forming a head related transfer function of a front center channel;

selectively reverberating a surround left channel and a surround right channel;

summing the selectively reverberated front left channel with the selectively reverberated surround left channel thereby forming a first left sum;

summing the first left sum and the head related transfer function of the front center channel thereby forming a second left sum;

summing the selectively reverberated front right channel with the selectively reverberated surround right channel thereby forming a first right sum;

summing the first right sum and the head related transfer function of the front center channel thereby forming a second right sum; and canceling cross talk between the second left sum and the second right sum to produce a left channel simulation signal and a right channel simulation signal.

2. The method of claim 1, wherein:

said step of forming a head related transfer function includes performing a cascade of at least one resonator and/or anti-resonator.

3. The method of claim 1, wherein:

each step of selectively reverberating includes providing at least one delay of a left channel input;

selectively attenuating each at least one delay of the left channel input;

summing the selectively attenuated at least one delay of the left channel input thereby forming a first sum signal;

forming a first head related transfer function of the first sum signal relative to a listener's left ear;

forming a second head related transfer function of the first sum signal relative to a listener's right ear;

providing at least one delay of a right channel input;

selectively attenuating each at least one delay of the right channel input;

summing the selectively attenuated at least one delay of the right channel input thereby forming a second sum signal;

forming a third head related transfer function of the second sum signal relative to a listener's right ear;

forming a fourth head related transfer function of the second sum signal relative to a listener's left ear;

summing said first and fourth head related transfer functions thereby forming a third sum;

summing said third sum and the left channel input thereby forming a left channel output;

summing said second and third head related transfer functions thereby forming a fourth sum; and summing said fourth sum and the right channel input thereby forming a right channel output.

4. The method of claim 1, wherein:

each step of forming a head related transfer function includes performing a cascade of at least one resonator and/or anti-resonator.

5. The method of claim 1, wherein:

said at least one delay of the left input channel differs from said at least one delay of the right channel input.

6. The method of claim 1, wherein:

said step of providing at least one delay of a left channel input consists of providing a cascade of a plurality of delays; and said step of providing at least one delay of a right channel input consists of providing a cascade of plurality of delays.

7. The method of claim 6, wherein:

said step of selectively attenuating each at least one delay of the left channel input includes attenuating each of said plurality of delays; and said step of selectively attenuating each at least one delay of the right channel input includes attenuating each of said plurality of delays.

8. The method of claim 1, wherein:

said step of summing said third sum and the left channel input includes weighting the left channel input by a first weighting factor and weighting said third sum by a second weighting factor; and said step summing said fourth sum and the right channel input includes weighting the right channel input by said first weighting factor and weighting said fourth sum by said second weighting factor.

* * * * *